US006623830B2

(12) United States Patent
Lewis

(10) Patent No.: US 6,623,830 B2
(45) Date of Patent: Sep. 23, 2003

(54) SOAP RECEPTACLE

(75) Inventor: Marilyn S. Lewis, 737 Camp Wawa Rd., Schwenksville, PA (US) 19473

(73) Assignee: Marilyn S. Lewis, Schwenksville, PA (US)

( * ) Notice: Subject to any disclaimer, the term of this patent is extended or adjusted under 35 U.S.C. 154(b) by 0 days.

(21) Appl. No.: 09/865,340

(22) Filed: May 26, 2001

(65) Prior Publication Data

US 2003/0029738 A1 Feb. 13, 2003

(51) Int. Cl.[7] ..... D05C 17/00; B32B 33/00; B32B 3/02; D03D 27/00; A47K 5/08

(52) U.S. Cl. ..... 428/85; 428/91; 428/96; 428/97; 428/34.1; 428/36.1; 206/77.1

(58) Field of Search ..... 428/34.1, 36.1, 428/85, 96, 97, 91; 206/77.1

(56) References Cited

U.S. PATENT DOCUMENTS

| | | | | | |
|---|---|---|---|---|---|
| 1,659,644 | A | * | 2/1928 | Vernet | |
| 1,854,415 | A | * | 4/1932 | Miller | |
| 3,411,966 | A | * | 11/1968 | Couquet | 156/72 |
| D249,605 | S | | 9/1978 | Skermetta | D6/89 |
| 4,112,161 | A | * | 9/1978 | Sorrells | 428/95 |
| 4,278,719 | A | * | 7/1981 | Sarnecki | 428/78 |
| 4,371,576 | A | * | 2/1983 | Machell | 428/94 |
| 4,422,546 | A | | 12/1983 | Charity | 206/77.1 |
| D285,396 | S | | 9/1986 | Odate | D6/536 |
| 4,828,898 | A | * | 5/1989 | Bailey | 428/88 |
| 5,279,412 | A | | 1/1994 | Lee | 206/77.1 |
| 5,763,040 | A | * | 6/1998 | Murphy et al. | 428/96 |
| 5,876,827 | A | * | 3/1999 | Fink et al. | 428/95 |

OTHER PUBLICATIONS

Web page http://www.ameripol.com/asc/2000/polymer2000.htm, Ameripol Synpol Specialty Products, 2001.

Web page http://www.hbfuller.com/asc/polymer/nonwoven.html, H. B. Fuller Company, 2000.

Web page http://www.aviationproducts.net/beacon/beacon.html, Aviation Products, Inc., 2000.

Web page http://www.basf.de/en/produkte/farbmittel/farben/textil/products/asia/finishing/?us=162 and downloaded product descriptions, BASF, 1999.

Web page http://www.basf.de/en/produkte/farbmittel/farben/textil/products/asia/finishing/?us=159, BASF, 1999.

Product label for "Aleene's Stiffen Quik," Duncan Enterprises, 1999.

Product label for "Aleene's Fabric Stiffener & Draping Liquid," Duncan Enterprises, 1999.

Product label for "Aleene's OK To Wash–It," Duncan Enterprises, 1999.

Product label for "Stiffy Fabric Stiffener," Plaid Enterprises, Inc., 1998.

Product label for "Petal Porcelain, setting agent," Plaid Enterprises, Inc., 1995.

Product label for "Stiffen Stuff," Beacon Chemical Company, date unknown.

Product label for "Stiffy, Glow in the Dark Fabric Stiffener," Plaid Enterprises, Inc., date unknown.

* cited by examiner

*Primary Examiner*—Harold Pyon
*Assistant Examiner*—Catherine A. Simone
(74) *Attorney, Agent, or Firm*—Paul & Paul

(57) ABSTRACT

A soap receptacle for minimizing or preventing water erosion of soap and the resulting residue. The receptacle is formed of a pile textile fabric saturated with a stiffening agent in a predetermined shape. The soap receptacle is rigid and is capable of embodying ornamental designs in the textile fabric. The textile material in the receptacle, including the pile material, permits associated water to be absorbed and evaporated, thus avoiding erosion of the soap and the resulting residue.

14 Claims, 3 Drawing Sheets

SOAP RECEPTACLE

BACKGROUND OF THE INVENTION

1. Field of the Invention

The present invention relates to soap receptacles and in particular to soap receptacles for minimizing or preventing water erosion of soap and the resulting residue.

2. Brief Description of the Prior Art

Traditional soap receptacles are generally simple constructions formed of ceramic, glass, or other water impervious material. There are a myriad of designs of such soap receptacles incorporating different shapes and ornamental surface treatment. Soap receptacles share a common limitation in that their water impervious material tends to collect and retain moisture from soap which is returned to the receptacle wet after it has been used. The soap erodes as it rests in the associated water and it leaves an unsightly residue on the soap receptacle which tends to build up after repeated use.

This problem has been long recognized and the prior art contains a variety of means for attempting to deal with it. One technique is to provide a perforated metal surface upon which the soap rests, permitting moisture to drop through and the soap to dry by means of air circulation, as evidenced in Evans U.S. Pat. No. 3,019,549, but that requires the construction of a relatively complex structure which takes up room and is expensive. It also is less than perfect because of the direct contact between the soap and the receptacle surface between the openings. Another type of solution is an open mesh bag, as in Pierce U.S. Pat. No. 2,457,918, but that requires a rigid structure for suspending the bag which must be fixed into an adjacent wall surface or the like. Still another device is the formation of a floating soap receptacle from rigid foam polystyrene with a drain opening as in Altstadter U.S. Pat. No. 2,722,719, but that is limited in its usefulness to floating on water and is relatively complex and expensive to make. Another, relatively common, approach is to make the soap receptacle of sponge or sponge rubber which absorbs the water from the soap, as shown in Charity U.S. Pat. No. 4,422,546, Vernet U.S. Pat. No. 1,756,713 and Vernet U.S. Pat. No. 1,659,644, but that retains the moisture derived from the soap within the sponge structure, which requires that the soap be removed and the sponge compressed in order to remove it.

SUMMARY OF THE INVENTION

The present invention provides a soap receptacle which is rigid in structure like the traditional ceramic soap receptacles, but which is provided with water-absorbent textile material above the rigid base of the receptacle.

The soap receptacle of the invention is relative simple and inexpensive and easy to make in comparison to all prior such articles.

The soap receptacle of the invention consists in a pile textile fabric, formed in a dish-shaped receptacle, and impregnated on the back with a stiffener material, dried to rigidity to cause the fabric to retain the dish shape.

A principal object of the invention is to provide a self-drying soap receptacle.

A further object of the invention is to provide a self-drying soap receptacle which is of relatively simple construction and easy to make.

A further object of the invention is to provide a self-drying soap receptacle which can be produced in a vast number of different shapes.

A further object of the invention is to provide a self-drying soap receptacle which may be readily provided with surface ornamentation.

A further object of the invention is to provide a self-drying soap receptacle that can be produced in virtually any color or pattern.

DETAILED DESCRIPTION OF THE PREFERRED EMBODIMENTS

Figure 1:
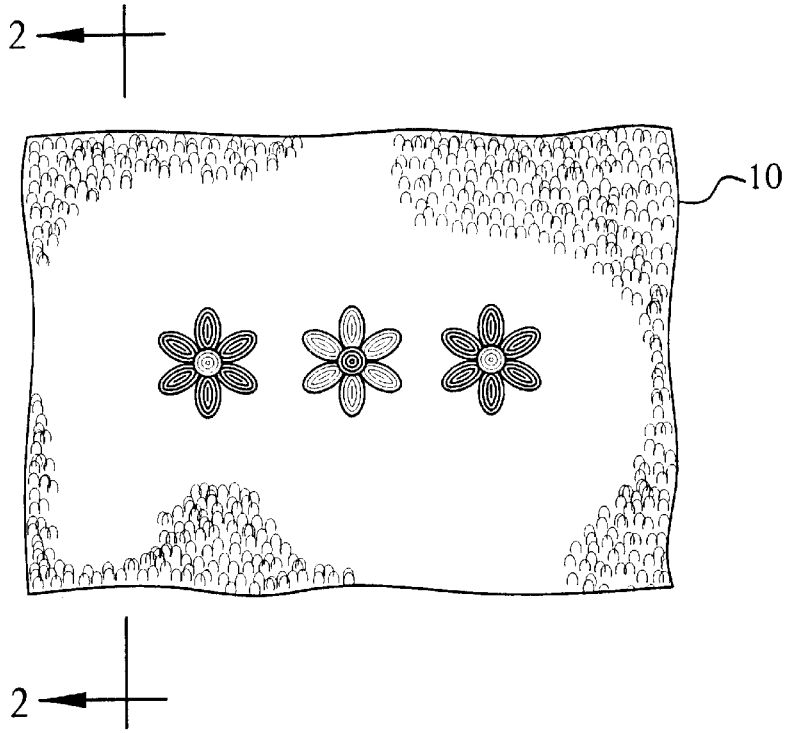
FIG. 1 is a plan view of a fabric for use in making the soap receptacle of the invention.

The base material of the invention is illustrated in FIG. 1 which shows the fabric 10 in plan view. Fabric 10 may be any woven, knitted or other common textile fabric having a nap, which is composed of a water absorbent textile material such as cotton. Any absorbent material may be used, including blends of cotton with synthetic materials. As will be seen, the water absorbent characteristic of the fabric is important both in forming the soap receptacle and in its use.

Figure 2:
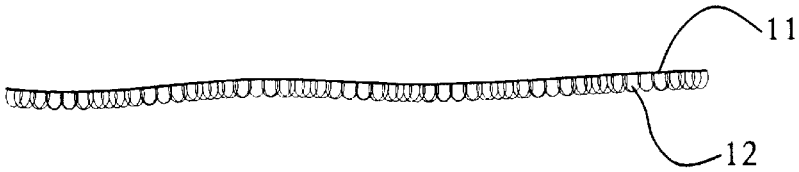
FIG. 2 is a sectional view through lines 2—2 of FIG. 1.

The fabric 10 is illustrated in cross-section in FIG. 2, showing the base weave or knit 11 and the pile material 12. The pile may be either cut or looped. The density and length of the pile may be varied to accomplish different results as will be explained hereinafter.

Figure 3:
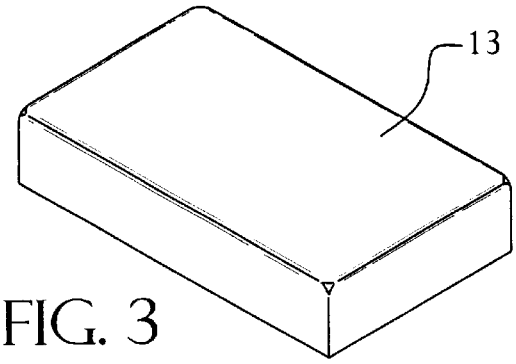
FIG. 3 is a perspective view of a dish shaped mold for use in making a soap receptacle of the invention.
Figure 4:
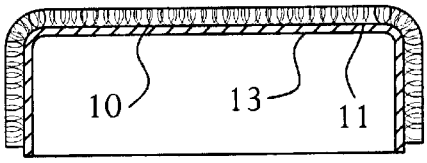
FIG. 4 is a sectional view showing the fabric of FIG. 1 in place on the mold of FIG. 3.
Figure 5:
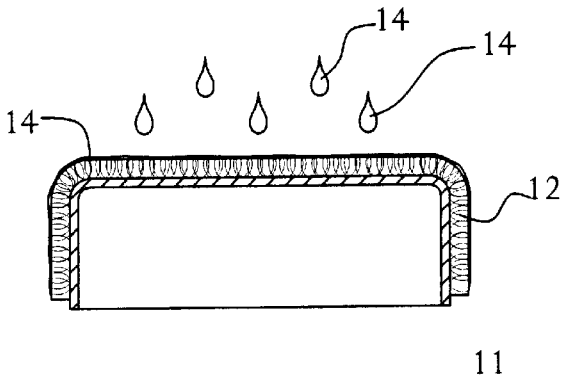
FIG. 5 is a view similar to FIG. 4 illustrating the application of a liquid stiffener material to the fabric.
Figure 6:
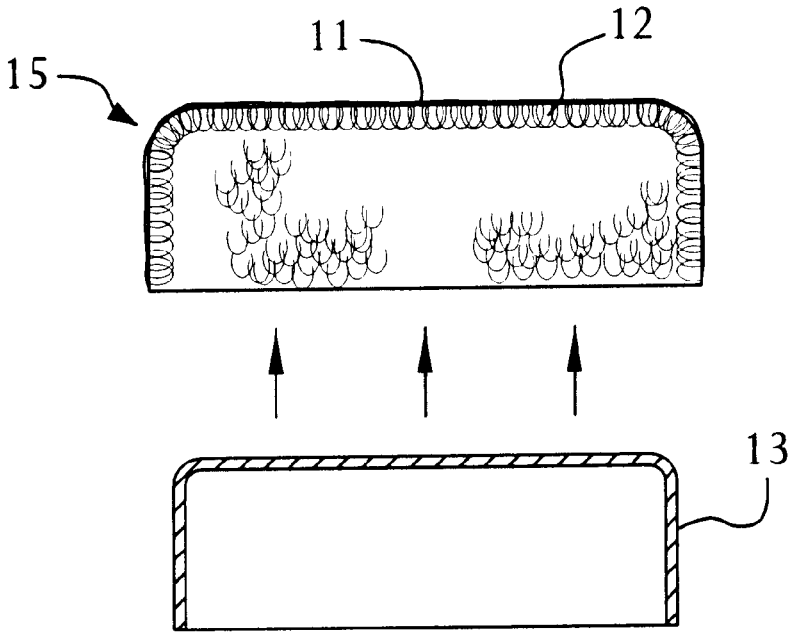
FIG. 6 is a sectional view similar to FIG. 5 illustrating the removal of the finished soap receptacle from the mold.

A typical mold 13 is illustrated in FIG. 3. It is to be understood that the mold may be of any shape depending upon the desired shape of the soap receptacle to be produced. In FIG. 4, the mold 13 is shown with the fabric 10 in place upon it with the pile 12 next to the mold surface. FIG. 5 illustrates the application of the stiffener material 14 which, in combination with the fabric 10, produces the resultant soap receptacle. The stiffener 14 may be of a wide variety of stiffener compositions, including those generally available, with the selection of the particular stiffener depending upon the results to be desired, as will be hereinafter explained. FIG. 6 shows the finished soap receptacle 15 being removed from the mold.

Figure 7:
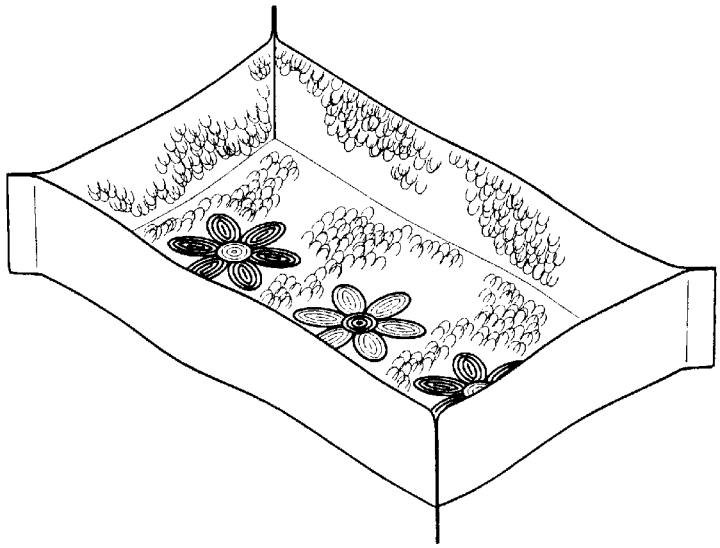
FIG. 7 is a perspective view of the soap receptacle of the invention.
Figure 8:
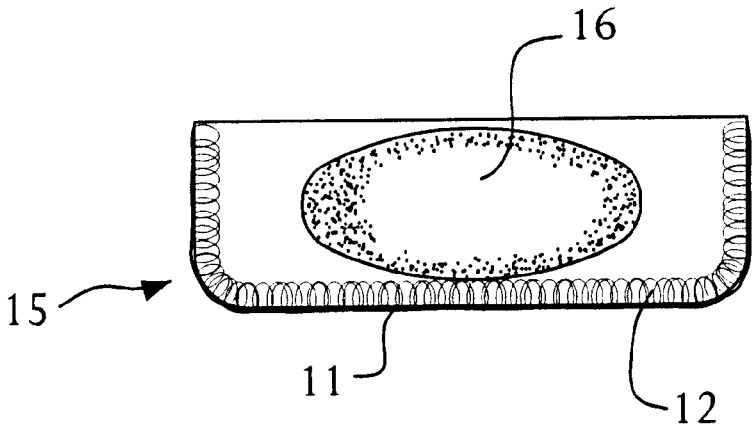
FIG. 8 is a sectional view of the soap receptacle containing a bar of soap.

FIG. 7 is a perspective view of the soap receptacle 15 after it is removed from the mold 13 and FIG. 8 is a cross-sectional view of the soap receptacle 15, the base fabric 11 and the pile 12. Also shown is a bar of soap 16 resting on the upper surface of the pile 12.

Although the nature and character of the base fabric 10 may be varied substantially while still obtaining the benefits of the invention, cotton terry cloth is particularly useful because it is relatively inexpensive yet provides a water absorbent material with enlarged pile loops, which serves to absorb the stiffener material 14 readily and to provide an optimum surface upon which the soap 12 rests. The function of the loops of the pile 12 in the finished product is to provide a surface raised above the base surface of the receptacle permitting the flow of air under the bar of soap when it is in place.

Different results may be obtained by varying the character and form of the pile 12. If a relatively soft cotton terry cloth material is used, the loops will be of significant length but will tend to lie flat in the concave surface of the soap receptacle 15. This will depend to some extent on the degree of penetration of the stiffener 14. If the pile loops become sufficiently impregnated with stiffener, they will tend to lie flat against the surface of the receptacle. Because of their irregularity and random displacement on the surface of the receptacle, they will provide a surface to support the soap slightly raised above the surface of the receptacle. If a relatively stiff cut pile is used, employing a proportion of synthetic fibers, the pile surface may be extended farther above the surface of the receptacle. Thicker pile yarns will tend to be more absorptive and a lower pile density will provide more room for the passage of air under the bar of soap. All such variations and others are available within the scope of my invention.

A wide variety of stiffening agents may be successfully employed in making the soap receptacle of the invention, ranging from a simple cornstarch emulsion to relatively sophisticated aqueous dispersions or emulsions of plastic materials.

The stiffening agent can be any water-soluble or water-dispersible material known in the art to provide a set to textile materials upon drying, such as ones sold by H. B. Fuller Company, P.O. Box 64683, St. Paul, Minn. 55164, Ameripol Synpol Corporation, 146 South High Street, Akron, Ohio 44308-1493 and BASF Corporation, 4330 Chesapeake Drive, Charlotte, N.C. 28216. Any commercially available fabric stiffener marketed in accordance with ASTMD-4236 would be acceptable. The same is true of any commercially available all-purpose water based glue product. Such products are marketed by Beacon Chemical Company, Mount Vernon, N.Y. 10550, Plaid Enterprises, Inc., Norcross, Ga. 30092-3500 and Duncan Enterprises, Fresno, Calif. 93727.

The method of making the soap receptacle of the invention may be varied. Instead of placing the fabric over a mold as I have illustrated in FIG. 4 and applying the stiffener to what ultimately becomes the bottom of the receptacle, as illustrated in FIG. 5, the fabric 12 may first be impregnated with the stiffening agent 14 and then formed over the mold as illustrated in FIG. 4 or, alternatively, it may be formed inside a hollow mold.

A soap receptacle made according to the invention is capable of absorbing small amounts of liquids such as are normally deposited by a bar of soap after use, without altering the shape of the soap receptacle. The water is absorbed into the body of the fabric and ultimately evaporated. If a non-permeable material is used, the flow of water would have no effect on the shape of the receptacle. If, however, a crosslinkable polymer material is used, such as is typical of the commercially available stiffeners, the soap receptacle may be drenched so as to lose its shape and then re-formed to rigid condition upon drying. In such circumstances, it is possible to change the shape of the soap receptacle as desired.

The soap receptacle of the invention may be either a permanent structure or a disposable one, depending upon the stiffener used. Because the body of the soap receptacle is a cloth fabric, any pattern created in that fabric will be retained and displayed in the soap receptacle. That makes it possible to provide any type of design in the soap receptacle providing a substantial facility for novelty or souvenir use. Thus, because of its relatively low cost of production, the soap receptacle could be used as a novelty souvenir by hotels, motels or other temporary residences. It also provides a useful article for sale in novelty shops.

While the particular characteristics of the soap receptacle made according to the invention may vary substantially by virtue of the material comprising the base fabric, the manner of formation of the base fabric, the particular composition of the stiffener, and the form of the mold, in every case the result is a soap receptacle of rigid character having at the same time the capacity to both absorb the water from a bar of soap, all in a unitary composite structure having no discrete parts, which is capable of varied surface ornamentation.

What is claimed is:

1. A soap receptacle for releasably holding a bar of soap, said soap receptacle consisting of a textile material having a base fabric and a pile, said base fabric being impregnated with an aqueous, water soluble or dispersible stiffener and said pile providing a surface for supporting the bar of soap and said soap receptacle being substantially rigid and having a predetermined shape.

2. The soap receptacle of claim 1 in which the textile material comprises cotton.

3. The soap receptacle of claim 1 in which the pile surface is a loop pile.

4. The soap receptacle of any one of claims 1 to 3 in which the textile material is a cotton terry cloth.

5. The soap receptacle of any one of claims 1 to 3 in which the stiffener comprises a polymer emulsion.

6. The soap receptacle of any one of claims 1 to 3 in which the stiffener is water permeable.

7. The soap receptacle of claim 1 in which the stiffener is water soluble or water dispersible.

8. The soap receptacle of any one of claims 1 to 3 in which the textile fabric bears an ornamental design.

9. The method of making a soap receptacle comprising placing a textile material over mold of predetermined shape, impregnating the textile material with an aqueous, water stiffener, drying the textile material while in situ on the mold and removing the resultant soap receptacle from the mold.

10. The method of making a soap receptacle comprising impregnating a textile material with an aqueous, water soluble stiffener, placing the impregnated textile material on a mold surface of predetermined shape, drying the textile material while in situ on the mold and removing the resultant soap receptacle from the mold.

11. The soap receptacle of claim 5 in which the textile material is a cotton terry cloth.

12. The soap receptacle of claim 6 in which the textile material is a cotton terry cloth.

13. The soap receptacle of claim 8 in which the textile material is a cotton terry cloth.

14. The soap receptacle of claim 1 in which the textile material is a non-laminate material.

* * * * *